US007845279B2

(12) United States Patent
Keren et al.

(10) Patent No.: US 7,845,279 B2
(45) Date of Patent: Dec. 7, 2010

(54) EXPLOSIVE MATERIAL SENSITIVITY CONTROL

(75) Inventors: Benjamin Keren, Misgav (IL); Yael Cohen-Arazi, Kfar Vradim (IL); Samuel Friling, Kfar Vradim (IL); Erez Hanina, Haifa (IL)

(73) Assignee: Rafael Armament Development Authority Ltd., Haifa (IL)

( * ) Notice: Subject to any disclaimer, the term of this patent is extended or adjusted under 35 U.S.C. 154(b) by 147 days.

(21) Appl. No.: 11/812,362

(22) Filed: Jun. 18, 2007

(65) Prior Publication Data

US 2008/0006020 A1 Jan. 10, 2008

(30) Foreign Application Priority Data

Jun. 21, 2006 (IL) ..... 176454

(51) Int. Cl.
*F42C 15/00* (2006.01)

(52) U.S. Cl. ..... 102/221; 102/364

(58) Field of Classification Search ..... 102/221
See application file for complete search history.

(56) References Cited

U.S. PATENT DOCUMENTS

| | | | | | |
|---|---|---|---|---|---|
| 4,522,190 | A * | 6/1985 | Kuhn et al. | ..... | 126/263.02 |
| 4,796,533 | A * | 1/1989 | Yunan | ..... | 102/322 |
| 4,893,563 | A * | 1/1990 | Baginski | ..... | 102/202.2 |
| 5,067,995 | A * | 11/1991 | Nutt | ..... | 149/2 |
| 5,147,476 | A * | 9/1992 | Beck et al. | ..... | 149/37 |
| 6,209,457 | B1 * | 4/2001 | Kenworthy et al. | ..... | 102/306 |
| 6,293,201 | B1 * | 9/2001 | Consaga | ..... | 102/363 |
| 6,343,000 | B1 * | 1/2002 | Yokoyama et al. | ..... | 361/247 |
| 7,089,861 | B2 * | 8/2006 | Forsthuber | ..... | 102/202.5 |
| 2004/0200378 | A1 * | 10/2004 | Schaefer et al. | ..... | 102/481 |
| 2007/0240600 | A1 * | 10/2007 | Skinner et al. | ..... | 102/481 |
| 2008/0251170 | A1 * | 10/2008 | Zavitsanos et al. | ..... | 149/22 |

* cited by examiner

*Primary Examiner*—Troy Chambers
*Assistant Examiner*—Samir Abdosh
(74) *Attorney, Agent, or Firm*—Susanne M. Hopkins; Ari G. Zytcer

(57) ABSTRACT

An armor module and an explosive material therefore, which explosive material is normally retained at a less sensitive position, and upon demand it is modified into a more sensitive position, where its initiation ability is upgraded and wherein the modification is carried out by heating the explosive material.

10 Claims, 3 Drawing Sheets

EXPLOSIVE MATERIAL SENSITIVITY CONTROL

FIELD OF THE INVENTION

The present invention relates to altering sensitivity of an explosive material so as to control its sensitivity between different states for different applications.

BACKGROUND OF THE INVENTION

High performance explosive compositions are long known and it is a goal for scientists to find new explosive compositions which can be defined as both low impact and shock sensitive, though offer high energy explosive performance. A combination of these properties offers higher transportation, storage and handling safety whilst not deteriorating the overall performance, of an explosive and an article holding it. For example, when applied in armor modules higher survivability is obtained, however without performance reduction, when compared to readily available explosive compositions of similar energetic properties.

Attempts have been made to desensitize solid high explosives, e.g. by mixing one or more energetic materials, relatively sensitive, with much less sensitive or with inert materials. The hope was to reduce the overall explosive sensitivity with increasing safety, and without significant effect on the overall performance of the mixture.

On the other hand, there are processes which successfully make insensitive explosives more sensitive. For example, some commercial slurry explosives are extremely insensitive which allows them to be safely transported through populated areas. When the explosive is emplaced, it is sensitized by mixing in a sensitizing agent, e.g. tiny glass micro-spheres (micro balloons).

A method for enhancing stability of high explosives is disclosed in U.S. Pat. No. 5,067,995 to Nutt, wherein the stability of porous solid high explosives, for purposes of transport or storage, is enhanced by reducing the sensitivity to shock initiation of a reaction that leads to detonation. The pores of the explosive down to a certain size are filled under pressure with a stable, low melt temperature material in liquid form, and the combined material is cooled so the pore filling material solidifies. The stability can be increased to progressively higher levels by filling smaller pores. The pore filling material can be removed, at least partially, by reheating above its melt temperature and drained off so that the explosive is again suitable for initiation.

SUMMARY OF THE INVENTION

It is an object of the present invention to provide an explosive material which is (normally retained at a less sensitive position, namely a position at which it performs as initially intended, and upon demand it is modified into a more sensitive position, where its initiation ability is upgraded.

The arrangement includes converting a substantially insensitive composition into a sensitive composition, as well as upgrading sensitivity levels.

The present invention also calls for a method and a system for upon-demand sensitizing a normally less sensitive explosive material by heating it. It is a further object to increase performance of an explosive material, and efficiency of an article carrying same, by heating the explosive material.

The present invention may be applied in a wide variety of applications, for example:

- Various types of explosive reactive armors;
- Boosters for various applications, such as for rockets/missiles;
- Warheads;
- Mines;
- Safe transportation, handling and storage of explosive materials and articles holding same.

According to the present invention, the explosive material used is substantially less sensitive than an explosive material which would have been used so as to obtain an equivalent effect/functional result, though without heating.

For example, when applying explosive material for armors it is a main goal to increase its performance, whilst maintaining safety. The following are several examples illustrating improvements achieved by applying heat to explosive reactive armor articles/modules:

- Improving efficiency of Explosive Reactive Armor (ERA) cassettes/modules, against hollow charges;
- Increasing efficiency of Explosive Reactive Armor (ERA) cassettes/modules against kinetic projectiles, which in the case of a standard armor cassette/module will typically penetrate it due to insufficient performance of the explosive material (the term kinetic projectiles as referred to herein calls for projectiles wherein the diameter is substantially low with respective to their length).
- Improving efficiency of Self Limiting Explosive Reactive Amor (SLERA) cassettes/modules by enhancing reaction zone up to complete detonation.

In the case of boosters, sensitivity of the explosive material may be altered from a 'safe position' wherein the explosive material is substantially insensitive and is not likely to initiate, into an 'armed position' wherein the explosive material is sufficiently sensitive so as to detonate upon initiation.

According to applications of the present invention the explosive material may be entirely heated, or only selective portions thereof, depending on a particular application. For example in the case of an explosive material used as in a booster, the explosive material may be heated at particular location only, for enabling initiation of the booster.

A potential heating member suited for applications according to the present invention, can have a wide range of heating capacity and temperature range. For example, in case of reactive armor cassettes/modules the heating capacity range is about 0.2-2.0 Watt/cm$^2$, where the resultant heating of the explosive material is in the range of about 70-150° C. However, for other applications, the heat capacity may be dependant upon volume/mass, e.g. for warheads the heating capacity may be defined in volumetric units as Watt/cm$^3$.

According to one particular embodiment of the present invention, there is provided a thermally isolating jacket over a reactive armor cassette/module. A thermal isolation member could be in the form of board or sheet material (e.g. foamed material). The isolating member could be also in the form of a double walled member holding a liquid or emulsion material. Moreover, other materials having substantially low heat conductivity, such as composite or ceramic materials, may also be used for thermal isolation, which in such cases the isolating material may also take part in the overall efficiency of the armor cassette/module. Thermal isolation will on one hand improve heating efficiency of the explosive material in the armor cassette/module, and on the other hand reduce the temperature at the vicinity of the reactive cassette/module (namely reduce heat within a vehicle fitted with a system according to the invention and thereby also reduce the thermal stamp of the vehicle).

According to various embodiments of the invention the explosive material is heated by a heating layer, such as a flexible sheet embedding therein conductive elements arranged in a pattern corresponding with a particular application, and adjoining the explosive material (embedded therein, bearing against or neighboring the explosive material, or bearing against an intermediate adjoining conductive material). One embodiment is a flexible elastomeric sheet.

According to a particular embodiment of the invention, the heating element is integrated with the explosive material during its manufacturing process, or later, e.g. by weaving, pressing, molding, etc. the heating elements into the explosive material.

The rate of heating the explosive material depends on several factors, such as, type of the explosive used, type of application, nature of threat, etc. For some applications sequential heating may be required, owing to energy consumption and thermal considerations.

According to another embodiment of the invention, one or more thermocouples are embedded in the explosive material for providing indication regarding temperature of the explosive material, so as to obtain indicia of its sensitivity level, and/or whether the explosive material is in its 'safe' or 'armed' position.

According to a further modification, there is provided a carrier board fitted with a heat-exchanging system and bearing a reactive armor being in heat-transfer association therewith. Optionally, the entire assembly or portions thereof, are thermally isolated, as discussed hereinbefore. For example, the heat-exchanging system may utilize heat of cooling liquids, or exhaust gases of an engine of a vehicle, e.g. a battle vehicle fitted with a reactive armor according to the invention. Still another option is utilizing Peltier heating elements.

BRIEF DESCRIPTION OF THE DRAWINGS

In order to understand the invention and to see how it may be carried out in practice, some embodiments will now be described, by way of non-limiting examples only, with reference to the accompanying drawings, in which.

DETAILED DESCRIPTION OF SPECIFIC EMBODIMENTS

Figure 1:
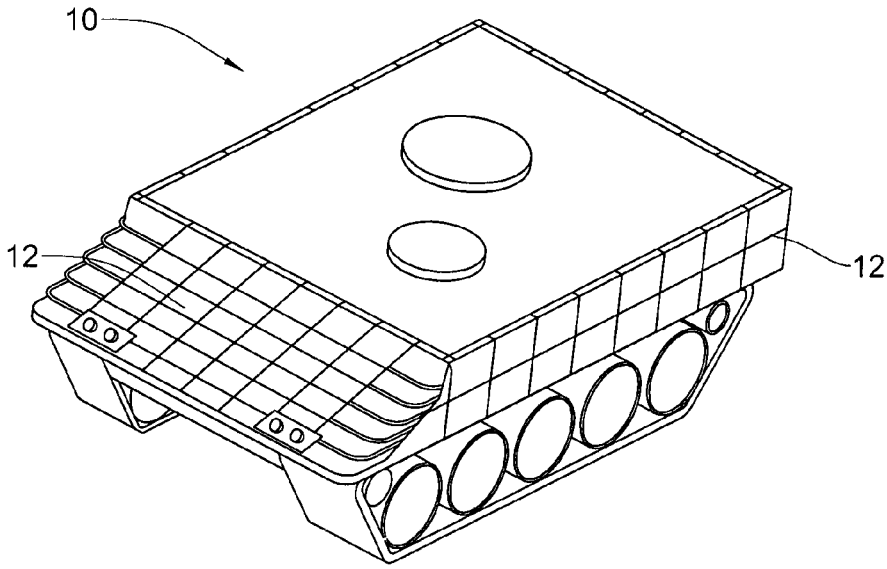
FIG. 1 is a representation of a battle vehicle fitted with reactive armor modules according to the present invention.

In FIG. 1, there is illustrated a combat vehicle 10 fitted on its exterior with a plurality of reactive armor modules 12 (as known per se, different configurations of reactive armors are fixed on the exterior of the vehicle to conform to the shape thereof).

Figure 2A:
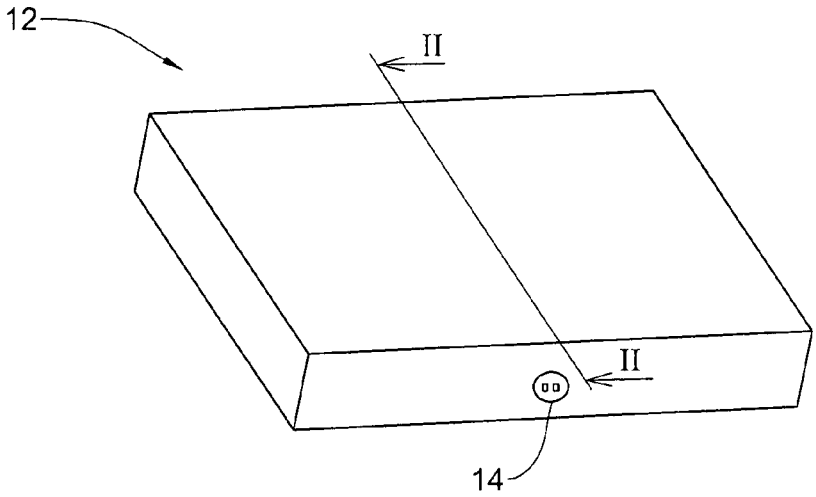
FIG. 2A is an enlargement of a reactive armor module in accordance with a specific embodiment of the present invention.

In FIG. 2A, there is a illustrated schematically, a reactive armor module 12 which is in the shape of a closed cassette fitted with an electric socket 14 electrically coupled to a power supply and control system (not shown) controllable by personnel of the combat vehicle 10. However, the module may be fitted within more than one cassette.

Figure 2B:
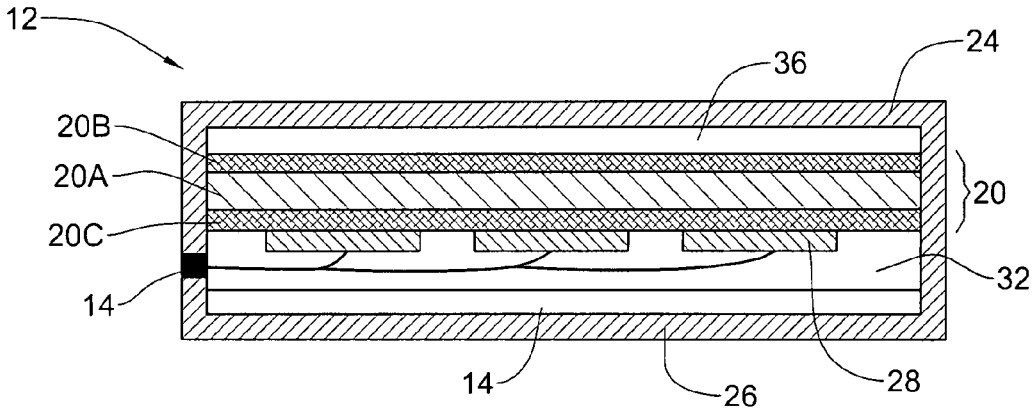
FIG. 2B is a section along line II-II in FIG. 2A.

As can be seen in FIG. 2B, the reactive armor module comprises a cassette 20 adjoining cover 24 of the armor module 12. The cassette 20 comprises a layer of explosive material 20A embedded between two plates 20B and, 20C, e.g. metal plates. Secured to the inner plate 20C, there is a heating element 28 electrically coupled to electric socket 14. The space 32 between the cassette 20 and the bottom cover 26, and the space 36 between the cassette 20 and the top cover 24 may be filled with a thermally isolating material e.g. foamed material, etc.

It is noticed that the armor module may include several cassettes and each cassette may be multi-layered. Furthermore, the thickness and component materials of each cassette may differ depending on the particular design of the reactive armor.

Furthermore, in an application comprising several cassettes in an armor module, the heating elements may be designed to yield different heat capacity for each of the cassettes, e.g. corresponding with the thickness of the explosive material and of the plates. It is also possible to sequentially heat the cassettes at a desired sequence.

According to other modifications, not illustrated, one or more of the cassettes fitted in a reactive module may comprise more than one layer of explosive material intermediately disposed between layers of metal, rubber, ceramic material, composite material, etc., wherein the thickness of such plates may be similar or different, as per different embodiments.

Figure 3A:
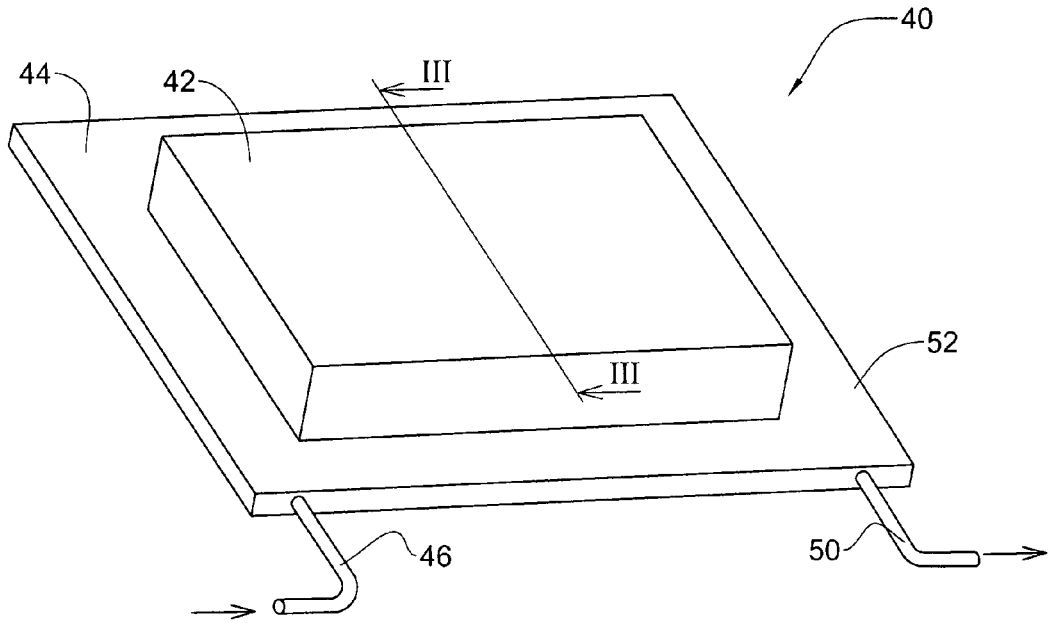
FIG. 3A is an isometric view of a reactive module in accordance with a modification of the present invention.
Figure 3B:
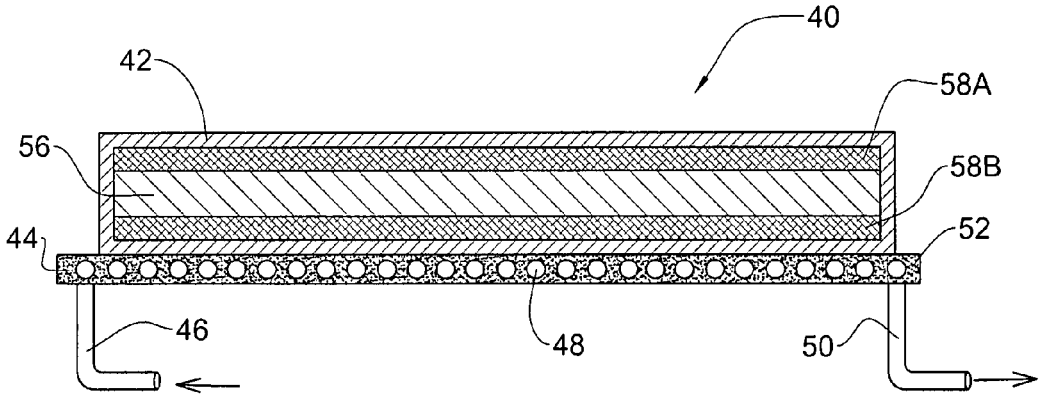
FIG. 3B is a section along III-III in FIG. 3A.

Turning now to FIGS. 3A and 3B, there is illustrated a modification of an armor module assembly in accordance with the present invention generally designated 40 wherein a reactive armor module 42 is attached to a heat exchanger plate 44.

The heat exchanger 44 comprises an inlet conduit 46 coupled to a source of hot fluid (e.g. cooling liquid of an engine of the vehicle 10 or, to a gas exhaust system thereof), and a plurality of undulating heat pipes 48 terminating at an outlet tube 50, which is either connected back to the heating source (e.g. in the case of a cooling liquid system) or out to the atmosphere (in case of a gas exhaust system). The arrangement is such that fluid flowing through conduits 48 transfers heat to the heating surface 52 of the heat exchanger 44, which in turn transfers heat to the cassette plate 58B and in turn to the explosive material 56 within the armor module 42 (in this case, the explosive material 56 is disposed between two conductive plates (e.g. metal plates 58A and 58B).

The arrangement in accordance with the present invention is such that heat is controllably and selectively applied to the reactive armor module so as to increase its efficiency between different sensitivity levels.

By one example a reactive armor module is heated so as to change its efficiency between a so-called safe position, namely a position at which the explosive material is insufficiently sensitive to initiate by a kinetic projectile, and a so-called armed position, namely such that upon striking by a kinetic projectile the explosive material will detonate to obtain the required protective effect.

Figure 4:
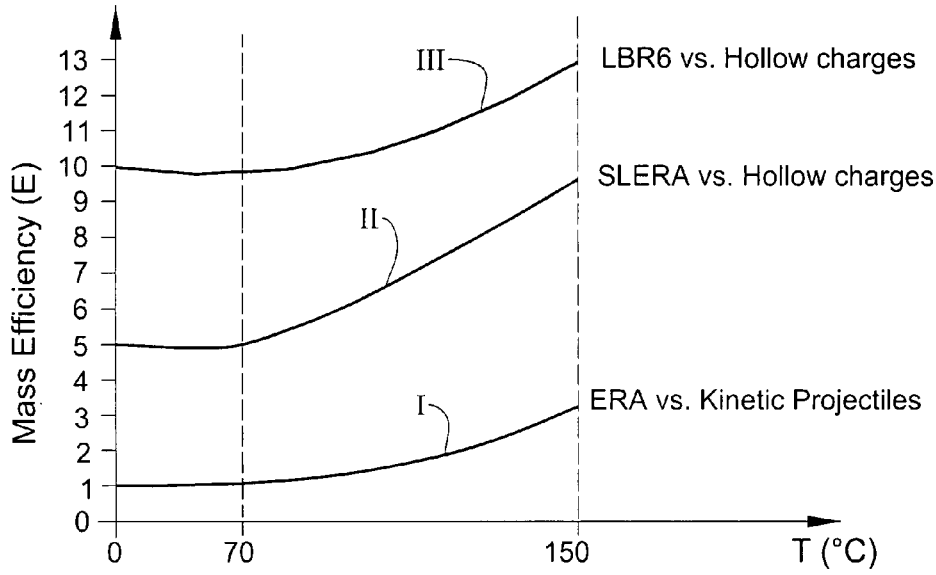
FIG. 4 is a schematic draft illustrating the mass efficiency Vs. temperature of different applications of armors.

In the schematic graph of FIG. 4, there are illustrated three types of explosive reactive armor concepts and the change of their mass efficiency (E, defining the ratio between the armor's mass and the equivalent mass of armor steel for obtaining the same performance) Vs. the explosive temperature (T expressed in degrees, centigrade). Line I represents how an explosive material which at a normal, unheated stage is completely inert to long kinetic projectiles (the term long kinetic projectiles as referred to herein calls for projectiles wherein the diameter is substantially low with respective to their length), though upon heating of the explosive material it becomes effective to a certain degree against such projectiles.

Line II illustrates a self limiting explosive material (fitted in SLERA) which at the normal, unheated position, will react locally against a hollow charge (namely, the explosive material will react at a restricted area only) whilst upon heating thereof will result in enhancement of the reaction zone up to complete detonation of the explosive material within the reactive armor. Heating may be, for example, up to 150° C.

Line III represents an explosive material, e.g. LBR6, which at the normal, non-heated position will detonate completely whilst upon heating up to about 150° C. will significantly improve the efficiency of the armor module holding the explosive material.

Figure 5:
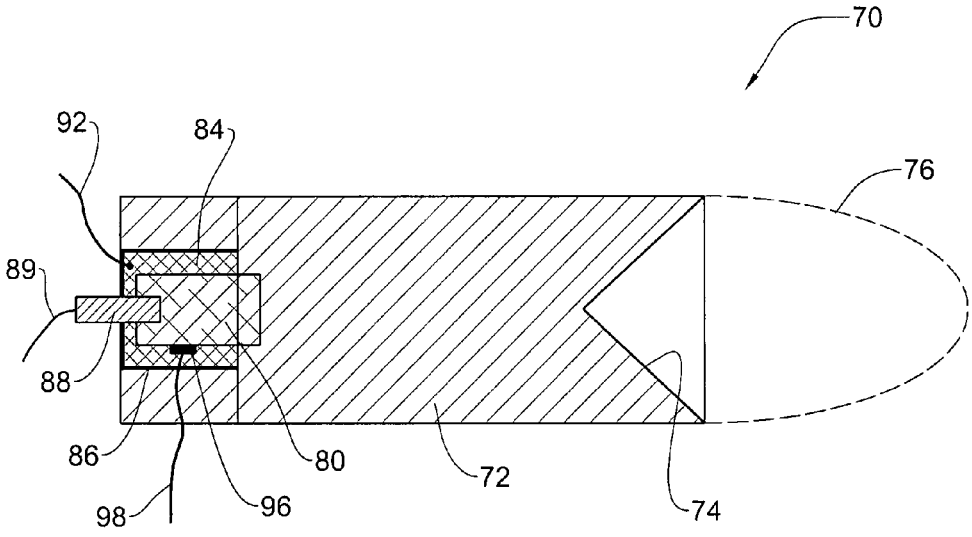
FIG. 5 is a schematic representation of a hollow charge fitted with a booster and a heating assembly, according to an application of the present invention.

In FIG. 5 of the drawings there is illustrated a hollow charge generally designated 70, fitted with a sensitivity control system according to an application of the present invention. The hollow charge comprises a main charge 72 formed with a V-like fore-end and fitted with a liner 74 as known per-se, extending before the domed hollow head 76. A booster 80 is fitted at a rear end, slightly extending into the main charge, said booster 80 fitted within a heating sleeve 84 which in turn may be fitted with a thermally isolating jacket 86. A detonator/fuse 88 extends into the booster 80, fitted with an igniter cord 89. The heating sleeve 84 comprises an electric supply line 92 for powering a heating array and there is further provided a sensor 96 electrically coupled by wiring 98 to a control unit (not shown) for indicating the status of the booster in terms of temperature or 'safe'/'armed' positions.

An advantage of this system is that the detonator 88 may be permanently fixed to the booster 80 and its arming may be readily obtained by heating. This is in contrast to the need in some known systems to keep the detonator separate from the booster and hollow charge (for safety reasons) unless it is to be used.

Whilst some embodiments have been described and illustrated with reference to some drawings, the artisan will appreciate that many variations are possible which do not depart from the general scope of the invention, mutatis, mutandis.

The invention claimed is:

1. A method for modifying the sensitivity of an explosive material having a normal less sensitive state and a more sensitive state, the method, comprising:

providing a less sensitive explosive material that is less sensitive in its normal state;

applying a flexible sheet adjoining the explosive material, the flexible sheet comprising conductive elements embedded therein and arranged in a predefined pattern; and heating at least a portion of the less sensitive explosive material in its less sensitive normal state to thereby modify its sensitivity to that of its more sensitive state, to produce a more sensitive explosive material, wherein the more sensitive explosive material has an initiation ability or functional ability that is upgraded from that of its normal less sensitive state.

2. The method according to claim 1, wherein the flexible sheet is a flexible elastomeric sheet.

3. A method for modifying the sensitivity of an explosive material having a normal less sensitive state and a more sensitive state, the method, comprising:

providing a less sensitive explosive material that is less sensitive in its normal state;

embedding in the less-sensitive explosive material one or more thermocouples for providing an indication of temperature so as to obtain indicia of its sensitivity level or whether it is in a 'safe' or 'armed' position; and heating at least a portion of the less sensitive explosive material in its less sensitive normal state to thereby modify its sensitivity to that of its more sensitive state, to produce a more sensitive explosive material, wherein the more sensitive explosive material has an initiation ability or functional ability that is upgraded from that of its normal less sensitive state.

4. A method for modifying the sensitivity of an explosive material, comprising:

providing a less sensitive explosive material that is less sensitive in its native state, having a first less sensitive native state and a more sensitive modified state, the less sensitive explosive material having an initiation ability or a functional ability;

applying a flexible sheet adjoining the explosive material, the flexible sheet comprising conductive elements embedded therein and arranged in a predefined pattern; and heating the less sensitive explosive material in its less sensitive native state under conditions sufficient to modify its sensitivity to that of its more sensitive modified state to produce a more sensitive material, wherein the initiation ability or functional ability of the more sensitive explosive material is upgraded from that of its less sensitive native state.

5. The method according to claim 4, wherein the flexible sheet is a flexible elastomeric sheet.

6. The method according to claim 4, further comprising prior to the step of heating, integrating a heating element with the less sensitive explosive material during or after its manufacture.

7. The method according to claim 4, further comprising prior to the step of heating, embedding in the less-sensitive explosive material one or more thermocouples for providing an indication of temperature so as to obtain indicia of its sensitivity level or whether it is in a 'safe' or 'armed' position.

8. The method according to claim 4, wherein the less sensitive explosive material is applied in an article selected from the group consisting of an armor module, a booster, a warhead, and a mine.

9. The method according to claim 4, wherein the less sensitive explosive material is entirely heated.

10. The method according to claim 4, wherein heating comprises heating only a portion of the less sensitive explosive material.

* * * * *